US005967902A

United States Patent [19]

Greenquist et al.

[11] Patent Number: 5,967,902

[45] Date of Patent: Oct. 19, 1999

[54] GOLF PUTTER AND METHOD

[76] Inventors: Gary Greenquist, 3308 Birch Pl., Minnetonka, Minn. 55305; David M. Lilly, Jr., 2800 Kenilworth Pl., Minneapolis, Minn. 55405

[21] Appl. No.: 09/087,615

[22] Filed: May 29, 1998

[51] Int. Cl.[6] ..... A63B 53/04; A63B 69/36

[52] U.S. Cl. ..... 473/253; 473/328; 473/340; 473/409

[58] Field of Search ..... 473/223, 226, 473/228, 242, 251, 257, 328, 344, 340, 252, 253, 254, 409

[56] References Cited

U.S. PATENT DOCUMENTS

| | | |
|---|---|---|
| 1,531,821 | 3/1925 | Scott . |
| 1,541,126 | 6/1925 | Dunn . |
| 1,835,718 | 12/1931 | Morton . |
| 3,680,868 | 8/1972 | Jacob . |
| 5,213,329 | 5/1993 | Okumoto . |

*Primary Examiner*—Sebastiano Passaniti
*Attorney, Agent, or Firm*—Friederichs Law Firm

[57] ABSTRACT

A golf putter and method is disclosed which allow accurate sighting and positioning of the golf putter head relative to the target or hole, and which has perpendicular elongated teeth that run along the bottom face of the putter head thereby increasing friction and reducing the resultant tendency for the putter head to twist when moving from a rearward optically accurate alignment position to a putting position. The accurate sighting is possible by tilting the golf putter rearward and sighting along the face and top of the putter head. This tilting causes a rear parallel tooth to engage the turf, keeping the putter head in position As the golfer moves from the sighting position. As to the golfing position, the golf putter is held in place, and when the putter is tilted back to the proper putting position, the rear tooth disengages the turf while at the same time the perpendicular elongated teeth engage the turf thereby preventing twisting of the putter head while moving from an alignment position to a putting position.

20 Claims, 2 Drawing Sheets

GOLF PUTTER AND METHOD

BACKGROUND OF THE INVENTION

1. Field of the Invention

The invention generally relates to a golf putter and method of putting and more particularly relates to putter alignment wherein the putter has both a mechanism on the (1) back and (2) bottom portion of the putter for providing an improved method for lining up the putter to thereby more accurately and consistently propel a golf ball along an intended line or path.

2. Description of the Related Art

Generally speaking, many or most prior art golf putters have a smooth or rounded bottom surface. Although this type of surface may facilitate the hitting of a putt, these smooth surfaces do not aide the process of initially aligning the putter nor do they contribute to the maintenance of alignment once it is established. As a consequence, prior art putters impair the golfer's ability to use an optimal aiming/alignment method. The present invention permits and assists in the use of an optimal aiming/alignment method.

Successful putting requires more than just a smooth stroke. If the ball is to roll into the cup, there are many physical and mental steps which must be successfully accomplished before the actual stroke. Putting can be usefully thought of as a three step process consisting of; (1) target selection from behind the ball (2) aiming/alignment of the putter to the target from behind the ball, and (3) stroking or hitting the putt from beside the ball.

The preferred aiming/alignment method essentially begins with the proposition that there is one best position to select a target and to align the putter—behind the ball. In this position a short distance behind the ball, the player crouches or bends with eyes and head level gazing directly above the ball's intended line of travels The player's body and feet generally straddle an imaginary line running from the target through the ball. The Rules of Golf, while permitting the golfer to select a target and align a putter from this preferred aiming/alignment position, prohibit the golfer from actually hitting the putt while so situated. (If the rules did permit the player to maintain this position during the stroke of a putt, a golfer could arguably use a putter like pool cue. Carried to an extreme, one could imagine a player prostrated on the putting surface as if it were a billiard table.)

Even though the Rules of Golf prohibit the putting of the ball from the preferred aiming/alignment position, virtually all golfers, except the rankest beginner, begin their putting routine from it. It is from behind the ball that a golfer is afforded an optimal view of ball, hole and surface contour. While crouched or bent in this location, the golfer is best able to assess the many factors, including contour, which will cause the ball's path to bend or "break" as the ball rolls toward the cup. Accomplished putters learn how to accurately assess both the contour of the green and numerous other subtle conditions (erg., the "grain" of the grass) and select an aiming target which accounts for the break of the putt. If the target is properly selected ("read" in golf vernacular), the putter accurately aimed or aligned to the target, and the putting stroke smoothly made; the ball will ultimately fall into the cup. It is the initial position of the golfer behind the ball in relationship to the cup that is the foundation of the preferred putter alignment method.

In contrast, any golfer attempting to "read" the green from the stroking or putting position standing beside and above the ball will be less successful. Although it is possible for the golfer to select a target from the stroking position, it is rarely done because such a position provides the worst possible view of the factors affecting the path of the ball along its intended line. Standing above the ball in the putting position reveals little in the way of ground contour or other important visual information necessary for a successful "read". This paucity of useful visual information is the result of the application of well understood optical/visual principals concerning contrast and depth perception. It is not surprising then that virtually all golfers will select an aiming target from the preferred aiming/alignment position behind the ball. The actual aiming target can be anything from a small blemish in the putting surface to a wayward leaf or speck of dirt.

Once the target has been selected from behind the ball, the preferred aiming/alignment method dictates that the golfer align or aim his putter from this position. However, due to the design of prior art putters, virtually all players move to the stroking position before aligning the putter to the selected target. Although it is possible to align prior art putters from the preferred aiming/alignment position, this initial alignment is highly unstable and virtually impossible to maintain while the golfer moves to the stroking position. Prior art putters do not provide a means to mechanically "fix" the correctly aligned putter while the golfer maneuvers his body to the correct position. Rather than contend with this lack of mechanical connection, most golfers prefer to align the putter to the target from the stroking position. Trying to aim the putter from the preferred position is problematic.

Any player attempting to align a prior art putter from the preferred position must rely on physical and athletic skill to maintain the putter's aim as the player shifts to the stroking position. Any movement of the player, the player's hands or other portion of the player's body after alignment is established is likely to cause an undesired change in the alignment of the putter. Moreover, the golfer may not be aware of the movement of the putter while the golfer is moving to the stroking position. Upon arrival at the stroking position, the player has no means to judge whether the putter has retained its alignment. It is the fragility of the putter's alignment that cause most players to attempt to align it from the stroking position. But, accurately aiming a putter from this position is inherently more difficult than aiming or aligning it from behind the ball.

This alignment challenge is analogous to aiming a pistol held no higher than the waist while turned sideways. Although it might be possible with practice to occasionally hit a bullseye from this position, greater accuracy is likely to result if one faces the target and the pistol is brought to eye level so that it can be sited along the actual line created by the target and the barrel of the pistol. Accurately aligning a putter while looking down upon it presents no less of a challenge. Moreover, the golfer must contend with optical anomalies and illusions which arise from this perspective. A number of highly respected books and articles have been written about the visual challenges inherent in aligning the putter from the stroking position. For an example of such materials see "Aim to Win" by Chuck Hogan.

In summary the preferred aiming/alignment method dictates that the golfer select an aiming target and aim the putter at the target from behind the ball. Prior art putters do not provide a workable means to fix the alignment of the putter while the player moves to the stroking position. Consequently, golfers are forced to aim the putter from the stroking position which results in less accurate alignment.

U.S. Pat. No. 4,000,902 discloses a golf putter with an in-line aiming and control apparatus which facilitates sighting the putter along the desired path of the ball by engaging the putting surface in order to keep the club in position as the golfer moves from the rear sighting position to the side golfing position. While this apparatus may achieve the desired aiming of the putter, the face of the putter has a sharp edge on the bottom side extending downward from the face and parallel to it. This sharp edge remains engaged with the turf as the putter is tilted back up. This prevents a smooth unimpeded takeaway or stroke. Also it has the tendency to catch and thereby slow down the putter speed or to cause the putter to twist if this edge inadvertently comes in contact with the turf during putting.

U.S. Pat. No. 4,919,428 (Perkins) discloses a putter with multiple grooves cut up into the bottom surface of the putter for engagement of the blades of grass growing out of the turf. The grass is not stiff enough to provide the putter head with lateral stability. And, the grooves do not engage the turf that underlies the grass. In order to be effective the turf must be received up into the grooves, which does not readily occur in either long or short putting surfaces. Even assuming that blades of grass could provide sufficient mechanical stability if engaged by the grooves, because most modem putting surfaces are closely mown, there is not sufficient grass to engage them. When used on the increasingly prevalent artificial putting surfaces like no-nap carpet or felt, the grooves have nothing to engage, Other types of golf clubs such as fairway woods and irons have used runners on the bottom surface of the club head. The runners for woods and irons are used to lift the club off the ground to reduce the chance that the club will dig in during the swing, i.e., prevent engagement with the turf and facilitate the passage of the club head over the ground. They are not intended nor do they function as a means to provide directional stability to the head of the club. These runners need sufficient surface contact to support the clubhead so that the head does not sink to the ground.

A need exists to provide an improved putter and method that will permit a golfer to more accurately align the putter's striking face and then permit the golfer to resume the normal putting position without changing the putterhead's alignment to thereby maintain the alignment of the putter and, at the same time, provide for a smooth and unimpeded stroke.

SUMMARY OF THE INVENTION

The present golf putter and method makes it much easier for a golfer to accurately aim a putter on a desired line by using the preferred alignment/aiming method. The present golf putter has been found to conform with USGA rules.

The present golf putter and method permits the putter to be tilted backward by the golfer while in a crouched position behind the ball thereby permitting the golfer to better visualize, by means of the use of a single or plurality of spared apart continuous lines running up the front face to the top of the putter and along the top of the putter.

The present invention provides a rear parallel tooth or a plurality of teeth on the bottom back of the head and running parallel to the putter's striking face to engage the putting surface and prevent the putterhead from twisting or inadvertently sliding forward into the ball while the golfer is attempting to aim the putter's striking face from behind the ball.

This improved golf putter and method uses a single or multiple elongated teeth running perpendicular to the putter's face that engage the turf or putting surface while the putter is in the upright position to prevent clubhead twisting while the golfer moves from behind the ball to the side of the ball in preparation to make the stroke.

This putter and method has single or multiple elongated teeth running perpendicular to the face and the single or multiple rear parallel tooth or teeth be used as a system so as the putter is tilted into the upright position the rear parallel tooth disengages the turf as the perpendicular elongated teeth engage the turf.

The improved golf putter and method of this invention comprises a shaft and a head which is fixedly connected to the shaft. The head of the putter has preferably a single or multiple elongated teeth, each of which has a thin, linear, ground contacting surface that extends below the rest of the bottom surface of the head, of the putter. These teeth are preferably substantially perpendicular to the putterhead's striking face and extend from the front of the head, to the back thereof. Although the teeth may also run parallel or diagonal to the face of the putter in order to provide the necessary frictional engagement with the putting surface, orienting the teeth substantially perpendicular allows for a smoother unimpeded putting stroke. A rear parallel tooth (or teeth) is located on a back bottom portion of the head of the putter and runs parallel to the putterhead's striking face. The teeth are positioned such that as the rear parallel tooth or teeth is disengaged during the tilting of the putter back into a vertical putting position (to free up the putter head from the turf to allow a free stroke) the perpendicular elongated teeth on the sole of the putter take over and engage the turf, preventing the blade from twisting off alignment while moving to the stroking position. The elongated teeth's primary function are as anti-twist devices during the aiming activity. If the single or multiple elongated teeth contact the underlying putting surface during the stroke, their configuration minimizes the surface area that could catch the turf and cause misdirection during the swing. The elongated teeth are beveled at the front and back to reduce drag caused by the teeth during the putting stroke. The elongated teeth also are pointed to increase rotational friction to frictionally position the putter during alignment but also reduce the front and bottom surface area of the teeth to reduce drag caused by the teeth during the putting stroke. The putter may also be tilted further backwards past the point of engagement of the rear parallel tooth on to back of the putter. The putter can then be more easily aligned without the frictional resistance of either the elongated teeth on the bottom of the putter or the rear parallel tooth on the back of the putter. The putter head also preferably contains single or multiple contrasting colored stripes that each continuously run across the top of the putter head and then around and down the striking face of the putter head. The middle stripe is preferably lined up with the middle of the shaft while each of the two other stripes are located, for example on opposite sides of the center stripe. The putter is tilted back during alignment far enough to align the putter using the stripe on the front face of the putter along with the stripes on the top of the putter. Alignment can also be enhanced by using the outside stripes in conjunction with the aiming target to detect alignment inconsistencies. The outside lines will appear differently depending on the location of the eyes and head above the putter during setup. As the eyes are moved out over the centerline of the putter the middle line located higher on the shaft will appear to move. In addition, the outside lines will appear out of alignment with the target.

The teeth of this invention are used for the opposite purpose of the runners of the prior art. The teeth of this invention are used to ensure engagement of the turf and to maintain the alignment of the putter while it is being aligned and while the golfer is moving from a position behind the ball, i.e., the preferred alignment position, to a putting position. The primary purpose of the teeth is to provide a method of engaging the putting surface during the alignment phase of the putting process so as to statically maintain the alignment of the putter up to the moment of the actual putting stroke. The teeth of this invention are designed to sink into the surface of the turf rather than ride on top of the surface like the runners in the prior art.

The foregoing and other objects, features and advantages will be apparent from the following description of the preferred embodiments of the invention as illustrated in the accompanying drawings.

DESCRIPTION OF THE PREFERRED EMBODIMENT

Figure 2:
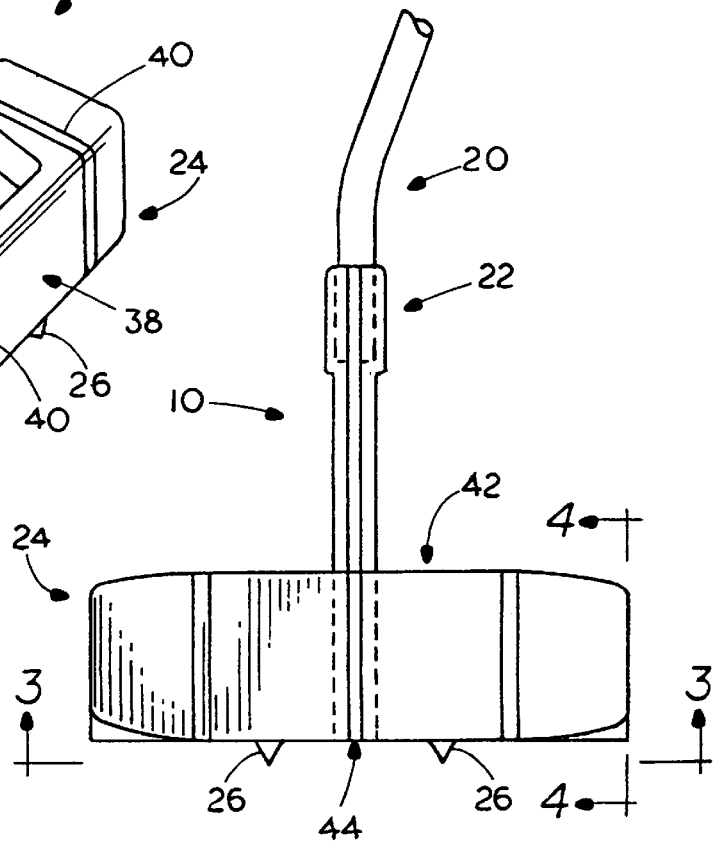
FIG. 2 is a front side elevational view of the golf putter of FIG. 1.
Figure 3:
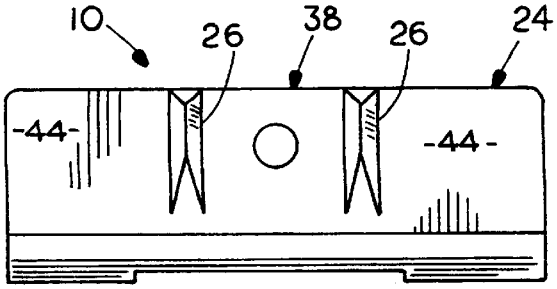
FIG. 3 is a view taken along the line 3—3 of the golf putter of FIG. 2.
Figure 4:
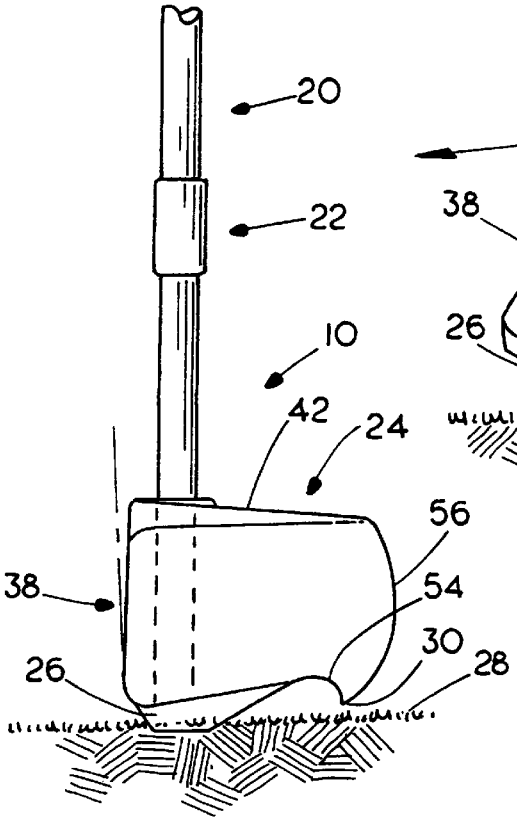
FIG. 4 is a view taken along the line 4—4 of the golf putter of FIG. 2 in its upright position with the elongated teeth engaging the turf.

With reference to all the Figures, the clubhead or head 24 has, preferably, a pair of downwardly extending elongated teeth 26 located on the bottom 44 of the head 24 that are each substantially triangular shaped (see FIG. 2) thereby having a pointed portion that provides a very narrow linear contact with the ground (putting surface or turf) beneath the putter 10. This contact between the elongated teeth 26 and the putting surface or ground 28 (see FIG. 4) provides engagement friction between the head 24 of the putter 10 and the ground 28 preventing undesired twisting of the head 24 during aiming.

At the rearward position of the head 24 of the putter 10 is a rear parallel tooth 30 that projects downward (see FIGS. 1, 4 and 5) which normally does not contact the ground 28 (see FIG. 4) when the head 24 of the putter 10 is positioned in its usual putting position (see FIG. 4) preparatory to striking the golf ball. However, when a golfer desires to line up the putter 10 to a golf hole or other target, he tilts the putter 10 rearward and lines up the putter 10 with the target. When the putter 10 is tilted rearward, as shown in FIG. 5, the rear parallel tooth 30 engages the ground 28 providing rotational frictional resistance to the twisting of the head 24 as well as lateral frictional resistance to moving the head 24 forward during alignment and inadvertently striking the ball.

The rear parallel tooth 30 has a gripping edge 54 that is preferably substantially linearly parallel to the face 38. The putter 10 may also be tilted further rearward past the point of engagement of the rear parallel tooth 30 with the ground 30. The putter 10 can than be aligned without the frictional resistance of either the rear parallel tooth 30 or the elongated tooth 26. The back 56 of the head 24 is preferably rounded or convex shaped to provide a smooth transition surface on which to tilt the putter 10 further rearward.

Figure 5:
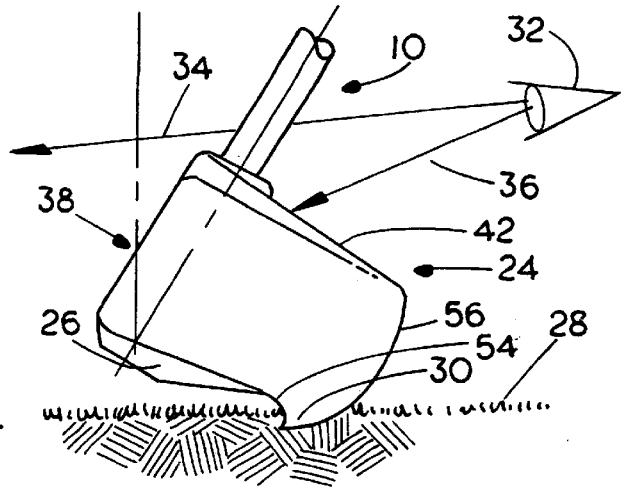
FIG. 5 is a side view of the golf putter as shown in FIG. 4 with the putter being tilted backward to permit contact between a rear parallel tooth that extends downwardly (located at the rear portion of the putter) that engages with the putting surface which allows a golfer to better view the golf ball, the golf hole and the golf club alignment and preventing the putterhead from inadvertently sliding into the ball during the aiming procedure (which would cause the golfer to incur a penalty)

FIG. 5 shows how a golfer uses their eye (or eyes) 32 to look at the target from behind the putter 10 (see arrow 34). The golfer also uses their eyes 32 to look at the head 24 of the putter 10 (see arrow 36). The golfer uses their eyes 32 to both line up and focus on the golf ball (not shown) and the golf hole or target (not shown) and thereby line up the head 24 of the putter 10 by viewing (see arrow 36) the top 42 of the head 24 of the putter 10 with respect to both the golf ball and the golf hole or target. The golfer may also use their eyes 32 to both line up and focus on the golf ball (not shown) and the golf hole or target (not shown) and thereby line up the head 24 of the putter 10 by viewing the face 38 of the head 24 of the putter 10 with respect to both the golf ball and the golf hole or target.

From the position shown in FIG. 5 where the golfer preferably stands behind the head 24 of the putter 10 to thereby line up the head 24 and face 38 of the putter 10 to strike a golf ball (not shown) towards a golf hole or other target (not shown), the golfer will tilt the putter into a normal upright position, (see FIG. 4), apply a slight downward pressure, and then walk part way round the putter 10 to assume a sideward position ready to strike the golf ball. However, since the elongated teeth 26 are still in contact with the ground 28 (see FIG. 5), this means that the golfer will unintentionally not move or twist the head 24 of the putter 10 because the elongated teeth 26 are in essentially a fixed position in the ground 28 thereby fixing and maintaining the desired alignment of the head of the putter 10 to the golf ball.

Figure 1:
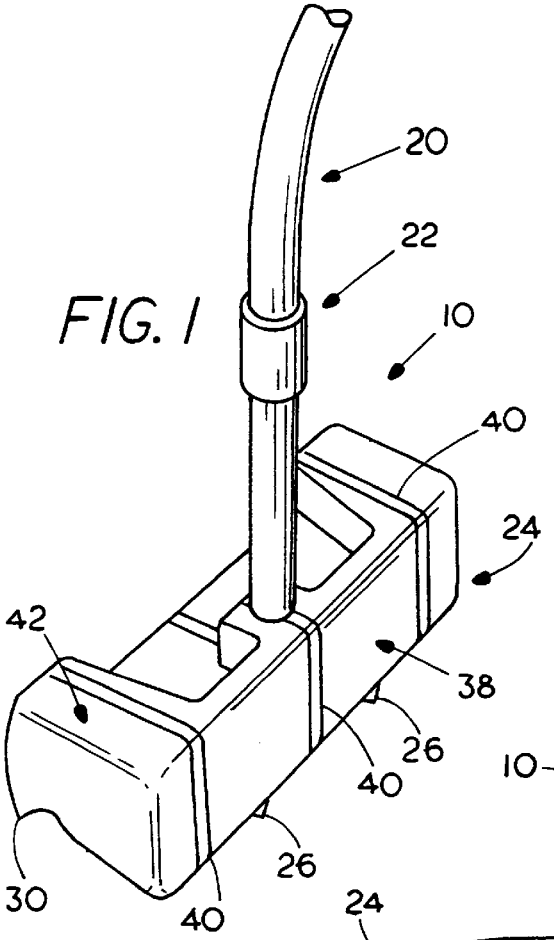
FIG. 1 is a perspective view of the bottom portion of a golf putter according to this invention.

In the operation of lining up the head 24 and face 38 of the putter 10 with the golf ball and the golf hole or other target, lines 40 (preferably three lines) are used and spaced apart as described above across the face 38 and top 42 of the head 24, see, for example, FIG. 1 showing the head 24 of the putter 10. These lines aid significantly in the aiming/alignment operation of lining up the head 24 and face 38 of the putter 10 with both the golf ball and the golf hole. With regard to FIG. 5 which depicts the technique used to line up the head 24 of the putter 10 with both the golf ball and the golf hole or other target, the lines 40 running across the top 42 and face 38 of the head 24 of the putter 10 make it much easier to eyeball where the head 24 and face 38 of the putter 10 should be positioned to permit the putter 10 to accurately strike or putt the golf ball in the direction of the golf hole.

Figure 6:
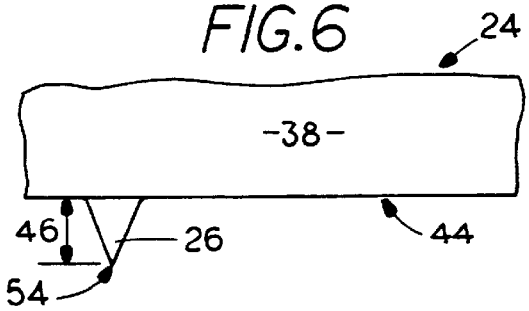
FIG. 6 is a partial detail front side elevational view of the golf putter of FIG. 1 showing an elongated tooth in more detail.
Figure 7:
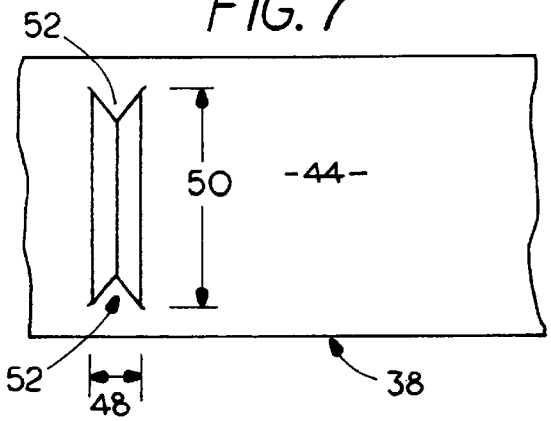
FIG. 7 is a partial detail bottom side elevational view of the golf putter of FIG. 1 showing an elongated tooth in more detail.

The elongated teeth are shown in more detail in FIGS. 6 and 7. The elongated teeth 26 are located on the bottom 44 of the head 24 of the putter 10. The elongated teeth 26 are preferably substantially perpendicular to the face 38 of the head 24. The elongated teeth 26 may have a length 50 up to the fill width of the putter head 24 from the front face of the head 24 to the back face of the head 24. Preferably the elongated teeth 26 have a length 50 of about 75% of the width of the head 24 from the front face 38 of the head 24 to the back face 56 of the head 24. The elongated teeth 26 may have a shorter length 50, or may not be elongated at all and could simply be a plurality of pointed spikes. The elongated teeth 26 are preferably triangular shaped as viewed looking at the face of the head 24 as shown if FIG. 6. The elongated teeth 26 preferably have beveled ends 52 at the face end and the rear end of the elongated teeth 26. The ends 52 may also be rounded instead of beveled. The rounded or beveled ends 52 reduce drag during the putting stroke. The beveled ends 52 help to provide an unimpeded stoke swing. The elongated teeth 26 are designed to aggressively engage the putting surface or ground 28. The elongated teeth 26 need to be angled enough to engage the ground 30 and provide enough friction between the putter 10 and the turf or ground 30 so that the putter 10 maintains alignment when the golfer moves from an aiming/alignment position to a putting position. In order to provide sufficient engagement the elongated teeth 26 preferably have a depth 46 about equal to or greater than their width 48. However, the elongated teeth 26 may have a depth 46 from about ⅓ to about 3 times their width 48. The elongated teeth preferably have a depth 46 of about ⅜ inch. However, the depth 46 may range from about ¼ inch to ½ inch.

The point 54 is preferably relatively sharp and not rounded. The point 54 needs to be sharp enough to engage the ground 30 and provide enough friction between the putter 10 and the turf or ground 30 so that the putter 10 maintains alignment when the golfer moves from an aiming/alignment position to a putting position. The point 54 should not be so sharp as to cause injury to the turf or ground 30 or injury to the golfer during handling. The point 54 is preferably similar in sharpness to a medium ball point pen or having a roundness diameter of about 0.050 inch or about 1 mm. The point 54 may have a sharpness ranging from a dull knife to a rounded point with a diameter of about 0.125 inch. Preferably there are two elongated teeth 26. As more teeth 26 are provided the surface area of the teeth begins to support the head off of the putting surface or ground 28 so that frictional resistance to twisting is reduced.

The elongated teeth 26 may also be designed to be removable or attachable to existing putters. Various methods of attachment may be used such as screw-on removable sole plates, glue on plates or the teeth alone could be releasable attachable through similar mechanisms.

While the invention has been particularly shown and described in reference to the preferred embodiments thereof, it will be understood by those skilled in the art that changes in form and details may be made without departing from the spirit and scope of the invention. For example, the elongated teeth 26, although having a triangular cross-section in the figures, can have different geometries or cross-sections such as semi-circular, so long as a reduced area of potential friction is provided.

We claim:

1. A golf putter comprising:

an elongated shaft having two ends, a handle coupled to a first of said two ends of said shaft; and a head coupled to a second of said two ends of said shaft;

said head having a face, a top, and a bottom;

said face of said head having a surface suitable for ball striking that is substantially perpendicular to the turf on which a golfer using said putter is golfing when said golfer correctly holds said golf putter by said handle in a normal putting position;

alignment means for holding said putter head in a fixed position, said alignment means having a first portion and a second portion;

said first portion comprising at least one elongated tooth for holding said head in a fixed position by engaging said turf when said shaft is in said normal putting position and for increasing friction between said head and said turf and coupled to said bottom of said head, said elongated tooth providing releasable engagement between said bottom of said head and said turf, thereby increasing rotational friction between said head and said turf;

said second portion comprising a rear tooth parallel to said face for holding said head in a fixed position by engaging said turf when said shaft is tilted rearwardly, said rear parallel tooth located on the rearward portion of said bottom of said head, whereby when said head is in a rearwardly tilted position for sighting and is returned to said normal putting position said second portion disengages said turf as said first portion engages said turf, thereby assuring said head does not change alignment after said sighting.

2. The golf putter of claim 1 further comprising a sighting means coupled to said top and to said face of said head for properly lining up said head with a golf ball to be putted.

3. The golf putter according to claim 2 wherein said sighting means comprises at least one stripe on said face of said head, said stripe connecting said top of said face to said bottom of said face in a direction normal to said turf when said head is in said normal putting position, and at least one stripe on said top of said head connecting to said stripe on said face of said head to provide a visual mark for said golfer using said golf putter to align said golf putter with said golf ball to be putted.

4. The golf putter of claim 1 wherein said elongated tooth is releasably attachable to said head.

5. The golf putter of claim 1 wherein said rear parallel tooth is releasably attachable to said head.

6. The golf putter of claim 1 wherein said elongated tooth has a width and a depth, said depth being from ⅓ to 3 times said width.

7. The golf putter of claim 6 wherein said depth is approximately equal to said width.

8. The golf putter of claim 7 wherein said depth is about ⅜ inch.

9. The golf putter of claim 6 wherein said depth ranges from about ¼ inch to ½ inch.

10. The golf putter of claim 1 wherein said elongated tooth has a triangular cross-section, with one side of said triangular cross-section attached to said bottom of said head such that the triangular point opposite said attached side is adapted to engage said turf.

11. The golf putter of claim 1 wherein said elongated tooth has a substantially pointed edge.

12. The golf putter of claim 11 wherein said pointed edge is sharp enough to engage said turf and provide enough friction between said head and said turf so that said putter maintains alignment when said golfer moves from said rearward position to said normal putting position but not so sharp as to cause injury to the turf or injury to the golfer during handling.

13. The golf putter of claim 11 wherein said pointed edge has a roundness diameter of about 0.050 inch.

14. The golf putter of claim 11 wherein said pointed edge has a sharpness ranging from a dull knife to a rounded point with a diameter of about 0.125 inch.

15. The golf putter of claim 1 wherein said rear parallel tooth engages said turf when said elongated shaft tilts said head in a rearward position, disengages said turf when said elongated shaft tilts said head in a further rearward position, and disengages said turf when said elongated shaft positions said head in said normal putting position.

16. A method of putting comprising the steps of:

providing an elongated shaft having two ends, a handle coupled to a first of said two ends of said shaft; a head coupled to a second of said two ends of said shaft, said head having a face, a top, and a bottom;

said face of said head having a surface suitable for ball striking that is substantially perpendicular to the turf on which a golfer using said putter is golfing when said golfer correctly holds said golf putter by said handle in a normal putting position;

an alignment means for holding said putter head in a fixed position, said alignment means having a first portion and a second portion;

said first portion comprising at least one elongated tooth for holding said head in a fixed position and for increasing friction between said head and said turf and coupled to said bottom of said head, said elongated tooth providing releasable engagement between said bottom of said head and said turf, thereby increasing rotational friction between said head and said turf; by engaging said turf when said shaft is in said normal putting position;

said second portion comprising a rear tooth parallel to said face for holding said head in a fixed position by engaging said turf when said shaft is tilted rearwardly, said rear parallel tooth located on the rearward portion of said bottom of said head, whereby when said head is in a rearwardly tilted position for sighting and is returned to sid normal putting position said second portion disengages said turf as said first portion engages said turf, thereby assuring said head does not change alignment after said sighting;

placing said head in said normal putting position with said face in close proximity with said golf ball to be putted;

tilting said head rearwardly until said rear parallel tooth engages said turf;

sighting along said head and moving said head to an appropriate position for properly putting said golf ball; and returning said head to said normal putting position thereby engaging said elongated tooth which prevents twisting of said head while said head is in said normal golfing position, thereby assuring that said appropriate position for properly putting said golf ball to be putted is maintained.

17. The method of claim 16 with the additional step of providing a sighting means coupled to said top and to said face of said head for properly lining up said head with a golf ball to be putted.

18. The method of claim 17 with the additional step of sighting along said sighting means and moving said head to an appropriate position for properly putting said golf ball.

19. The method of claim 16 with the additional step of tilting said head in a further rearward position wherein said elongated tooth disengages said turf when said elongated shaft tilts said head in a further rearward position, and disengages said turf when said elongated shaft positions said head in said normal putting position.

20. A golf putter comprising:

an elongated shaft having two ends, a handle coupled to a first of said two ends of said shaft; and a head coupled to a second of said two ends of said shaft, said head having a face, a top, and a bottom;

said face of said head having a surface suitable for ball striking that is substantially perpendicular to the turf on which a golfer using said putter is golfing when said golfer correctly holds said golf putter by said handle in a normal putting position; alignment means for holding said putter head in a fixed position, said alignment means having a first portion and a second portion;

said first portion comprising bottom friction means for holding said head in a fixed position by engaging said turf when said shaft is in said normal putting position and for increasing friction between said head and said turf, coupled to said bottom of said head, said bottom friction means providing releasable engagement between said bottom of said head and said turf, thereby increasing rotational friction between said head and said turf;

said bottom friction means being releasably attachable to said head;

said bottom friction means having a width and a depth, said depth being from ⅓ to 3 times said width;

said bottom friction means having a triangular cross-section, with one side of said triangular cross-section attached to said bottom of said head such that the triangular point opposite said attached side is adapted to engage said turf;

said bottom friction means having a substantially pointed edge;

said pointed edge being sharp enough to engage said turf and provide enough friction between said head and said turf so that said putter maintains alignment when said golfer moves from said rearward position to said normal putting position but not so sharp as to cause injury to the turf or injury to the golfer during handling;

said second portion comprising a rear friction means for holding said head in a fixed position by engaging said turf when said shaft is tilted rearwardly and disengaging said turf when said elongated shaft tilts said head in a further rearward position, said rear friction means located on the rearward portion of said bottom of said head, whereby when said head is in a rearwardly tilted position for sighting and is returned to said normal putting position said second portion disengages said turf as said first portion engages said turf, thereby assuring said head does not change alignment after said sighting; and a sighting means coupled to said top and to said face of said head for properly lining up said head with a golf ball to be putted.

* * * * *